US005644131A

United States Patent [19]

Hansen

[11] Patent Number: 5,644,131

[45] Date of Patent: Jul. 1, 1997

[54] HYPERBOLIC ION TRAP AND ASSOCIATED METHODS OF MANUFACTURE

[75] Inventor: Stuart C. Hansen, Palo Alto, Calif.

[73] Assignee: Hewlett-Packard Co., Palo Alto, Calif.

[21] Appl. No.: 651,367

[22] Filed: May 22, 1996

[51] Int. Cl.[6] ..... H01J 49/42

[52] U.S. Cl. ..... 250/292; 313/256; 445/49

[58] Field of Search ..... 250/292; 313/256; 445/49

[56] References Cited

U.S. PATENT DOCUMENTS

| | | | |
|---|---|---|---|
| 2,939,952 | 6/1960 | Paul et al. | 250/292 |
| 3,328,146 | 6/1967 | Hanlein | 65/60 |
| 4,885,500 | 12/1989 | Hansen et al. | 313/256 |
| 5,283,436 | 2/1994 | Wang | 250/292 |
| 5,298,745 | 3/1994 | Kernan et al. | 250/292 |
| 5,468,958 | 11/1995 | Franzen et al. | 250/292 |
| 5,525,084 | 6/1996 | Broadbent et al. | 445/49 |

FOREIGN PATENT DOCUMENTS

| | | |
|---|---|---|
| 2737903 | 3/1979 | Germany . |
| 0091651 | 5/1984 | Japan . |

OTHER PUBLICATIONS

Köhl, "Materials and Techniques for Electron Tubes," *General Telephone & Electronics, Technical Series 1960* TK 6565.V3,K65 C4, pp.20–25 and 66–69.

*Primary Examiner*—Jack I. Berman

[57] ABSTRACT

A hyperbolic ion trap is provided that includes a glass ring electrode and first and second glass end-cap electrodes. Hyperbolic surfaces of the electrodes are coated with a conductive material. The glass ring electrode and glass end-cap electrodes are formed by conforming glass substrates to a refractory mandrel and establishing hyperbolic surfaces thereon using vacuum and heat. Mass spectrometers including a glass hyperbolic ion trap are also provided as well.

36 Claims, 2 Drawing Sheets

HYPERBOLIC ION TRAP AND ASSOCIATED METHODS OF MANUFACTURE

TECHNICAL FIELD

The invention relates generally to components of a mass spectrometer and methods for manufacturing those components. More particularly, the invention relates to a glass hyperbolic ion trap, methods of forming the ion trap, and devices which use the ion trap for performing mass spectrometric analysis.

BACKGROUND OF THE INVENTION

Mass spectrometry is used for quantitative elemental analysis, identification of chemical structures and the determination of molecular weight and/or composition of mixtures. Mass spectrometry can be used to ascertain the molecular weights of molecules or the identity of components of a sample, based on the detection of a fragmentation pattern of ions produced when the material is ionized.

Mass spectrometry involves the formation of ions from analyte molecules, the separation of the various ions according to their mass-to-charge ratio (m/z) and the subsequent generation of a mass spectrum obtained from the separated ions as a result of their having passed through an electric field, a magnetic field or a combination thereof. In practice, positively and negatively charged ions are formed from a sample of molecules using, for example, electron impact, chemical ionization, atmospheric pressure ionization, fast atom bombardment, thermospray or electrospray techniques. The ions are accelerated to form an ion beam. Discrete mass fractions contained within the ion beam are then selected by a mass analyzer, such as a single-focusing or double-focusing mass analyzer, a time-of-flight mass analyzer or a quadrupole mass filter.

A mass spectrum of the ions can thus be produced and detected, providing a molecular fingerprint of the analyte molecule. The spectrum conveys information regarding the molecular weight of the molecule and, if fragmentation occurs during ionization, information characteristic of the position and bonding order of molecular substructures of the analyte molecule. In this way, a mass spectrum allows for the identification of molecules or compounds present within a sample.

An ion trap detector is a three-dimensional analog of a quadrupole mass filter, in which ion formation, storage and scanning operations may be performed within a single chamber. Typically, mass scanning is controlled by a radio frequency (rf) signal applied to a centrally located circular ring electrode disposed between two end-cap electrodes which are held at ground potential. Ions that have been formed inside the ion trap, or introduced therein from an associated ionizing means, are stored within the ion trap. Scanning operations can be conducted using a number of known methods to mass analyze stored ions. Ion traps can be used for conducting complex chemical and biochemical analyses of compounds, wherein high sensitivity, high mass range for molecular weight determination, and the capability for both mixture analysis and structural evaluation are important.

The conducting surfaces of the ring electrode and the two end-cap electrodes in an ion trap are ideally hyperbolic in cross section. The hyperbolic conducting surface of the ring electrode provides a first set of hyperbolic surfaces (Hyperbola set 1), and the hyperbolic conducting surfaces of the end-cap electrodes provide a second set of hyperbolic surfaces (Hyperbola set 2). The cross-sections of the two sets of hyperbolic surfaces should be complementary, and follow the general equations $$\text{Hyperbola set (1): } r^2/(r_0)^2 - z^2/(z_0)^2 = 1,$$

and $$\text{Hyperbola set (2): } r^2/(r_0)^2 - z^2/(z_0)^2 = (-)1.$$

The machining settings for "r" and "z" that are used to fabricate the hyperbolic surfaces can be obtained using the Laplace condition $$(r_0)^2 = 2(z_0)^2,$$

with $$r^2 - 2z^2 - (r_0)^2 = 0;$$

and $$r^2 - 2z^2 + (r_0)^2 = 0.$$

The hyperbolic ring electrodes and end-cap electrodes of contemporary ion traps are typically fabricated from solid metals, such as stainless steel, using machining settings derived as explained above. Stepped surfaces result that are then finished using fine polishing. The selection of particular ($r_0$) values depends upon the amplitude and frequency of the rf power supply to be employed and the desired mass range for detection. Once the metal electrodes have been machined, they must be insulated and spatially registered with each other using posts, washers and bands made from an insulating material such as ceramic to form an ion trap assembly. The high precision required of the complex machined hyperbolic surfaces result in high manufacturing costs. Further, the need to provide numerous external supports to assemble the ion traps, such as expensive ceramic insulating and/or registering components, increases material cost and results in labor intensive assembly of contemporary metal ion traps.

Accordingly, there remains a need in the art to provide an alternative ion trap electrode set which can be readily manufactured with high precision hyperbolic surfaces and assembled into a self-registering ion trap assembly.

SUMMARY OF THE INVENTION

It is an object of the invention to provide a hyperbolic ion trap comprising a glass ring electrode with an interior surface having a generally hyperbolic cross section coated with a conductive electrode material. The ion trap further includes first and second glass end-cap electrodes with interior surfaces having generally hyperbolic cross sections also coated with a conductive material. The conductive hyperbolic surfaces of the ring electrode and end-cap electrodes are aligned with each other to define the volume of a hyperbolic ion trap chamber.

The glass ring electrode and end-cap electrodes can optionally include self-registering features. In one aspect of the invention, the self-registering features comprise centering details formed in the interior surfaces of the end-cap electrodes. The centering details allow the end-cap electrodes to be accurately aligned with the ring electrode, which provides for ease of assembly and disassembly of the glass hyperbolic ion trap assemblies. The use of self-registering features eliminates the need to provide insulating posts, washers and bands to spatially register and insulate the ring and end-cap electrodes in the ion trap assemblies.

In related aspects of the invention, the glass ring electrode and the glass end-cap electrodes are formed from quartz substrates. The replacement of prior machined metals with glass materials, as provided herein, greatly reduces the cost and labor associated with the manufacture of hyperbolic surfaces for ion trap electrodes. Glass electrodes tend to be less susceptible to minor inelastic deformations characteristic of metal electrodes. Glass electrodes may also be readily tested for potential high-stress areas using polarized light. It is also an object of the invention to provide a method for manufacturing glass hyperbolic ion traps. The method involves formation of the ring electrode and the end-cap electrodes by conforming glass substrates to a mandrel using vacuum and heat. The conforming process enables preparation of precise three-dimensional surface features of generally hyperbolic cross section on the substrates. The conformed substrates are converted to electrodes by coating the hyperbolic surfaces with a suitable conductive material.

In a related aspect of the invention, the ring electrode and the two end-cap electrodes can be formed simultaneously about a single split mandrel. Further, the mandrel can include means for providing self-registering features to the conformed substrates.

In a further embodiment of the invention, a mass spectrometer is provided having a glass hyperbolic ion trap. The mass spectrometer can be used to mass analyze a wide variety of analytes using known methods of mass spectroscopy.

DETAILED DESCRIPTION OF THE INVENTION

Before the invention is described in detail, it is to be understood that this invention is not limited to the particular component parts of the devices described or process steps of the methods described as such devices and methods may vary. It is also to be understood that the terminology used herein is for purposes of describing particular embodiments only, and is not intended to be limiting. It must be noted that, as used in the specification and the appended claims, the singular forms "a," "an" and "the" include plural referents unless the context clearly dictates otherwise. Thus, for example, reference to "a conductive material" includes mixtures of conductive materials, and the like.

In this specification and in the claims which follow, reference will be made to a number of terms which shall be defined to have the following meanings:

The terms "glass" and "glass substrate" are used interchangeably herein to refer to substances generally made by fusing silicates, borates or phosphates with basic oxides. Thus the term encompasses silicon glass (borosilicates), fused silica glass and quartz.

A "conductive material" is broadly defined herein to include any body or medium that is suitable for carrying electric current.

A "mandrel" is used herein to refer to a body which serves as a core around which another material can be cast, forged, extruded or otherwise formed to provide a true central cavity of a selected geometry and dimension.

A "thermal coefficient of expansion" is a measure of the degree to which a material expands when heated. The thermal coefficient of expansion of a particular material can be expressed as the fraction change in length or volume of that material per unit change in temperature. A negative coefficient indicates that a material contracts when heated.

In one embodiment of the invention, a hyperbolic ion trap is formed from three glass substrates each having conductive coatings disposed upon hyperbolic surfaces thereof. Suitable glass substrates include, for example, borosilicate (Pyrex®) glass having at least about 70 to 80 wt. % silica. However, quartz substrates are preferred, particularly those quartzes having at least about 90 wt. % silica. Exemplary quartzes useful in the practice of the invention include fused silica and titanium silicates having about 7 wt. % titanium oxide. Such materials are characterized by low loss factors and high thermal resistance. These characteristics are particularly well suited for high performance mass spectrometry.

Figure 1:
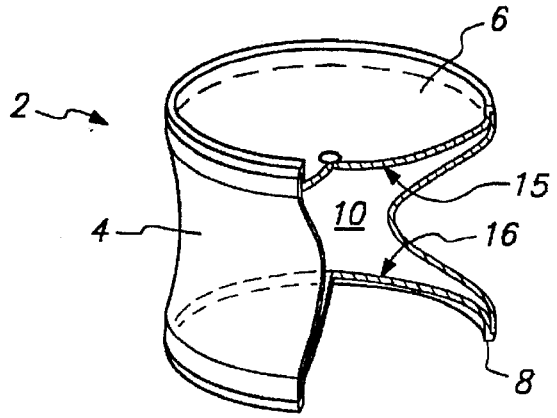
FIG. 1 is a pictorial representation of a glass hyperbolic ion trap shown in three-quarter cut-away section.
Figure 2:
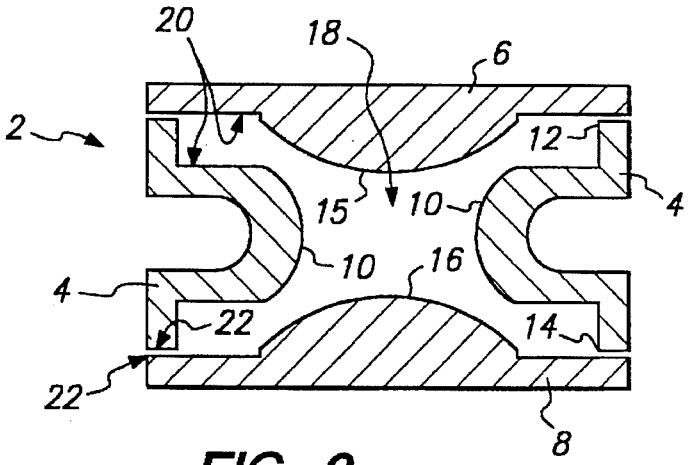
FIG. 2 is a cross-sectional representation of a glass hyperbolic ion trap, depicting the arrangement of the hyperbolic surfaces of the electrodes in the hyperbolic ion trap chamber.

Referring now to FIGS. 1 and 2, a glass hyperbolic ion trap made in accordance with the invention is generally indicated at 2. The ion trap has been shown in section to represent the three-dimensional spatial relation of the hyperbolic surfaces of a glass ring electrode 4, a first glass end-cap electrode 6 and a second glass end-cap electrode 8. The ring electrode has a convex interior surface portion 10 having a generally hyperbolic cross section, a first open terminus 12, and a second open terminus 14. The first end-cap electrode 6 has a convex interior surface 15 having a generally hyperbolic cross section. The second end-cap electrode 8 also has a convex interior surface 16 of generally hyperbolic cross section.

Referring particularly to FIG. 2, when the ion trap 2 is assembled, the first end-cap electrode 6 is aligned within the first open terminus 12 of the ring electrode such that its convex interior surface 15 is adjacent to the convex interior surface 10 of the ring electrode. The second end-cap electrode 8 is aligned within the second open terminus 14 of the ring electrode such that its convex interior surface 16 is adjacent to the convex interior surface 10 of the ring electrode, and in facing relation with the convex interior surface 15 of the first end-cap electrode, thereby defining the hyperbolic chamber 18 of the ion trap.

As best seen in FIG. 1, wherein the glass hyperbolic ion trap 2 is depicted in three-quarter section, the convex interior surfaces of the ring electrode and the first and second end-cap electrodes are coated with a conductive material to form the conductive hyperbolic surfaces of a hyperbolic chamber 18. Specifically, the convex interior surface 10 of the ring electrode 4 and the facing convex interior surfaces 15 and 16 of the first and second end-cap electrodes 6 and 8, respectively, are each coated with a suitable conductive material. Preferred conductive materials include silver, copper, titanium, chromium, aluminum, nickel, hafnium, gold and combinations thereof.

Optionally, the ion trap 2 can include high-resistivity (low-conductivity) coatings which are applied to prevent ion charging of areas disposed between the conductive portions of the ring electrode and the adjacent end-cap electrodes, as well as at points of contact between the electrodes. Referring now to FIG. 2, one set of complementary interior surface areas of the first end-cap electrode 6 and the ring electrode 4 is generally indicated at 20. In addition, one set of points of register between the second end-cap electrode 6 and the ring electrode 4 is generally indicated at 22. The surface areas 20, and the contact, or register points, 22 are generally "empty" glass areas which are capable of being charged with stray ions during use of the ion trap in mass spectrometry. These stray ions can remain on the empty glass areas and, over time, develop electric potential. This unwanted charging lowers the overall performance of the ion trap device, for example by reducing peak resolution of mass spectra.

Accordingly, empty glass areas, such as those indicated at 20 and 22, are preferably coated with high-resistivity materials to reduce or eliminate unwanted charging. High-resistivity materials suitable for use herein include those formed from a metal-oxide slurry that preferably contains a bonding agent. An exemplary slurry can be formed by mixing zirconium oxide with a solution of potassium silicate in water. Alternatively, a chromium oxide slurry or a suspension of carbon (graphite) in a binder, such as aquadags (DAGs), can be used. DAGs are generally known in the art, and are typically used for minimizing charge accumulations in cathode ray tubes and oscilloscopes. The metal-oxide slurry or DAG coating is preferably applied to the electrodes so as to overlap adjacent edges of the conductive coatings on the hyperbolic surfaces 10, 15 and 16 of the ion trap electrodes. Application of the high-resistivity coatings can be effected by firing metal oxide bearing slurries, optionally including a bonding agent such as potassium silicate to ensure adherence of the coating to the glass substrate.

In constructing the present ion trap, ideal hyperbolic cross sections of the trap electrodes are mathematically determined to provide two sets of conductive hyperbolic surfaces which are complementary to each other, thereby establishing a predetermined ideal electric field within the hyperbolic chamber. Generally, very demanding tolerances are required of the complementary hyperbolic surfaces, e.g., maximum errors within the range of ±50 μinches, in order to avoid serious performance limitations. In practice, the glass or quartz hyperbolic surface approximations differ from the ideal, thereby introducing non-idealities to the ion trap that are not easily susceptible to mathematical characterization. However, using routine design development, the non-idealities in the complementary hyperbolic surfaces can be minimized.

In another embodiment of the invention, a method is provided for manufacturing a glass hyperbolic ion trap. The method comprises forming the three glass electrodes, applying conductive coatings to the hyperbolic surfaces of the electrodes, optionally applying high-resistivity coatings and assembling the ion trap. The first step of the method further includes a preliminary step of providing suitable mandrels for forming the glass electrodes.

Figure 3:
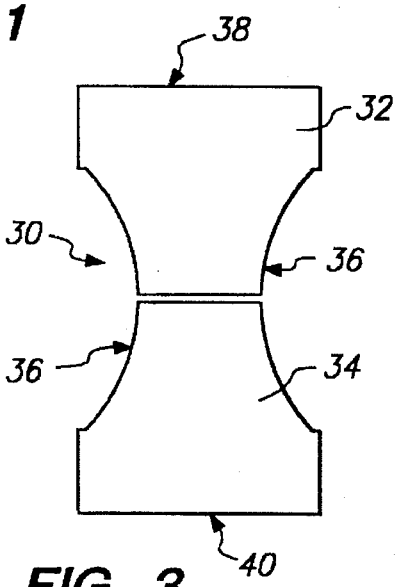
FIG. 3 is a plan view of a split mandrel used to form the glass ring electrode assembly.

In order to form glass or quartz electrodes having hyperbolic surfaces, it is necessary to provide a mandrel that is able to maintain its structural integrity through repeated exposure to the elevated temperatures used to form or mold glasses. When softer glass substrates are used, the mandrel can be formed from materials such as stainless steel and nickel. If quartz is to be used, the mandrel can be formed from refractory metals such as molybdenum, tungsten and an alloy of hafnium, carbon and molybdenum (HCM). Alternatively, the mandrel can be formed from carbon or graphite. It has been established that each of these materials can be machined, ground and polished with high precision to provide the appropriate shapes and dimensions required to form a mandrel, such as the split mandrel 30 depicted in FIG. 3, which can be used to form glass ring electrodes having hyperbolic surfaces.

The split mandrel 30 is formed from first and second component halves, respectively indicated at 32 and 34. The component halves are fitted together to form a mandrel body configured such that its external dimensions correspond to the internal dimensions of the ring electrode substrate to be manufactured at formation temperatures. Metal materials which are used to form the mandrel 30 are selected so as to have greater thermal coefficients of expansion than the glass substrate. Thus, the mandrel is dimensioned to be relatively smaller than the interior of the ring electrode at ambient temperature. The mandrel 30 has a substantially centrally located concave annulus 36 which extends latitudinally about the exterior surface of the mandrel. Further, the mandrel 30 has first and second polar exterior surfaces, 38 and 40, respectively.

Figure 4:
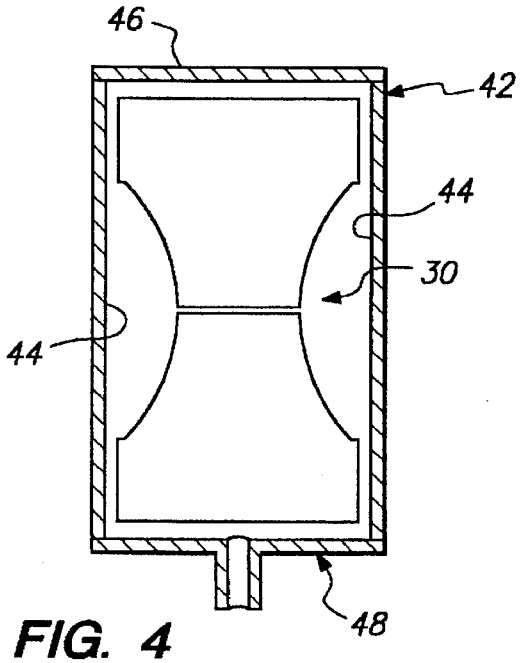
FIG. 4 is a sectional view of the split mandrel of FIG. 3 inserted axially into a glass substrate.

Referring now to FIG. 4, an elongate glass tube, which is the precursor for a ring electrode, can be derived from a glass substrate 42 having an interior surface 44. The glass substrate generally comprises an elongate cylindrical body of appropriate diameter and thickness which has been sealed or blown closed at one end 46. The assembled mandrel 30 is then inserted axially into the glass substrate 42, followed by capping the second end of the glass substrate with a vacuum connector means 48. The vacuum connector means allows for connection with an externally associated vacuum pump in order to evacuate the interior of the sealed glass substrate, causing an internal/external pressure differential. Formation of the elongate glass tube is effected by heating the glass substrate 42 to a sufficient temperature of formation whereby the glass is urged by atmospheric pressure to tightly conform about the exterior surfaces of the mandrel 30. If desired, a second vacuum connector means can be provided at the sealed end 46 of the glass substrate 42 in order to equalize evacuation of the substrate. The heating process can also be conducted in sections, starting at a central portion of the substrate, and moving out towards each end, either sequentially or simultaneously.

Figure 5:
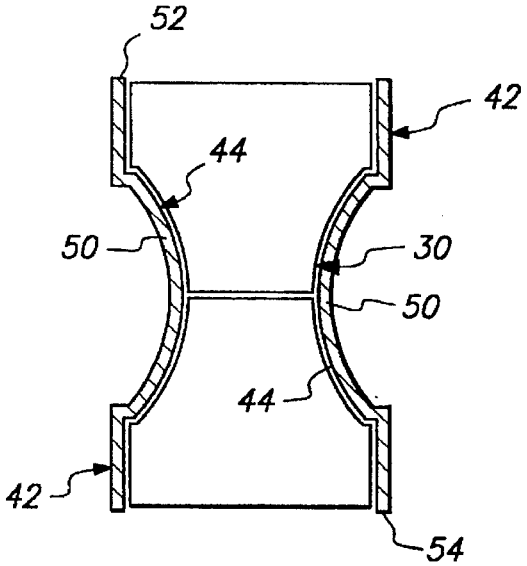
FIG. 5 is a sectional view of a glass tube which has been conformed to the split mandrel of FIG. 3 using vacuum and heat.

As can be seen by reference to FIG. 5, the interior surface 44 of the glass substrate 42 assumes a three-dimensional configuration which matches the dimensions of the exterior surface of the mandrel 30. A centrally located convex annulus 50 is thereby formed on the interior surface 44 of the substrate, wherein the convex annulus has a generally hyperbolic cross section which closely matches that of the concave annulus 36 on the exterior surface of the mandrel. After the glass substrate has conformed to the exterior surface of the mandrel, both the glass and the mandrel are allowed sufficient time to cool, during which time the mandrel will contract more rapidly than the glass. After cooling, the sealed end 46 and the vacuum cap 48 are removed from the substrate 42, such as by cutting the glass substrate with a diamond saw or other suitable cutting means. The mandrel 30 is then removed from the glass substrate by detaching the first and second halves, 32 and 34, of the mandrel from each other and then extracting the halves from either side of the substrate. The molded substrate is then trimmed to any desired length, and the cut ends can be ground or otherwise polished or smoothed.

In this process, glass substrate 42 is transformed into an elongate glass tube having a first open end 52, and a second open end 54 and an interior surface with a centrally located convex annulus 50 of generally hyperbolic cross section. The convex annulus 50 is formed in the interior surface 44 of the glass substrate. The elongate glass tube is used to form a ring electrode as described below. While the glass substrate used to form the ring electrode can be selected from a wide variety of suitable glasses, it is preferred to form the electrodes from quartz. Quartz substrates can be selected to avoid or minimize the thermal and electrical effects known to impair performance of the ion trap, particularly at mass settings of 800 amu or greater. Relevant material parameters include the thermal stress resistance and the thermal coefficient of expansion of that material. Particular quartzes useful herein include a quartz comprised of about 96.5 wt. % silica, 3 wt. % borate and 0.5 wt. % alumina, fused silica (i.e., 99.9 wt. % $SiO_2$ and 0.1 $H_2O$), and ultra-low-expansion titanium silicate comprised of about 93 wt. % silica and about 7 wt. % $TiO_2$. These materials all have a thermal stress resistance greater than 100° C. and a thermal coefficient of expansion less than $1\times10^{-6}$ at temperatures in the range of approximately 0° C. to 300° C. This combination of values is well suited for a mass spectrometer device operating at a mass setting greater than 800 amu.

The ring electrode is formed by applying a conductive coating to the hyperbolic surface of the convex annulus 50 of the elongate glass tube. The conductive coating can be applied using a variety of alternative methods generally available to those skilled in the art. Suitable conductive materials include, but are not limited to, metals such as gold, silver, copper, aluminum, nickel, titanium, hafnium, chromium and combinations thereof. The conductive materials can be applied to the hyperbolic surface of the glass tube using chemical deposition, such as mirroring or chemical vapor deposition (cvd). Alternatively, evaporative (e.g., physical vapor deposition) or sputtering techniques can be used. If desired, a chromium strike can be deposited first, with a second conductive material applied to the strike. The chromium strike provides for good adherence to glass, and provides a diffusion barrier to prevent other conductive materials, such as gold, from entering into the glass or quartz substrate. Other metallization or coating techniques will be apparent to the skilled practitioner upon reading the present specification. The coatings are applied so as to be thick enough to ensure electrical continuity. However, the thickness of the coating must be kept substantially uniform to ensure that the hyperbolic shape of the underlying glass substrate is matched by the exterior surface of the conductive coating.

In one preferred coating method, the ring electrode is formed by applying a thin film of conductive material to the hyperbolic surface of the glass substrate 42 using electroplating or electroless plating techniques. Preferably, the plated conductive material is a noble metal or a mixture of noble metals, with gold particularly preferred. Noble metal substrates do not develop an oxide film in an air environment, are relatively inert and have low resistivity. Plating substrates with oxide-free surfaces are desirable, since electroplated metals may fail to form strong bonds with metal oxides.

Further, since gold or other noble metal plating substrates may not form strong bonds with the glass ring electrode substrate, a thin-film adhesion/diffusion barrier (e.g., a strike layer) can be sputter deposited onto the hyperbolic surface of the glass substrate. The strike layer can be formed from any suitable substrate, for example from titanium, chromium, tungsten, or combinations thereof. Titanium and chromium form strong bonds with glass; however, these materials can diffuse at temperatures in excess of 150° C., possibly causing adhesion problems and interfering with the electroplating process. On the other hand, tungsten has excellent diffusion characteristics. However, tungsten/silicon dioxide bonds are not as strong as either titanium/silicon dioxide or chromium/silicon dioxide bonds.

In one method then, a thin film titanium/tungsten layer is sputter deposited onto the glass ring electrode. The titanium/tungsten composite layer generally comprises approximately 10 to 15 wt. % titanium and approximately 85 to 90 wt. % tungsten. Alternatively, a separate adhesion layer and a separate diffusion barrier layer can be applied. Titanium, chromium or another suitable metal can be applied to the glass substrate to provide an adhesion layer. A diffusion barrier layer can then be coated onto the adhesion layer. The diffusion barrier layer can be formed from platinum or tungsten, or any other suitable material.

If desired, the strike layer or layers can be deposited using a mask to shield portions of the electrode surface that will not be coated with the conductive material. The gold or other noble metal plating substrate is then electroplated or electroless plated over the titanium/tungsten strike layer shortly after formation thereof.

In an alternative coating method, the ring electrode is formed using a metal foil decal which includes a conductive material such as silver. Other components of the decal can include bonding agents and/or glass (e.g., silver-glass frit tape). When silver-glass frit tape is used, the tape is applied to the hyperbolic surface of the glass substrate and then fired to fuse the glass in the tape to the adjacent hyperbolic surface of the substrate. Metallization decals can also be used herein, such as those having four layers: a carrier layer (e.g., cellophane); a coating layer (e.g., silver); an adhesive layer; and a protective layer (e.g., paper). The decal can be applied by removing the protective layer to expose the adhesive, positioning the tape on the hyperbolic surface of the glass substrate, removing the carrier layer, and then firing the tape at a temperature sufficient to ensure adherence of the tape to the substrate.

In yet a further alternative method, the conductive coating can be applied during the conforming of the glass substrate to the mandrel. Specifically, conductive materials suspended within suitable carriers can be applied to the mandrel 30, such as upon the concave annulus 36. As the glass substrate is conformed to the exterior surface of the mandrel, or upon cooling, the conductive materials adhere to the glass, rather than to the mandrel. Additionally, conductive coatings can be applied to the interior surface 44 of the glass substrate 42 prior to conformance to the mandrel. In this manner, the resultant electrode is conformed to the mandrel directly.

Furthermore, high resistivity coatings can optionally be applied to the ring electrode to prevent ion charging of areas disposed between the conductive portions of the electrode and adjacent end-cap electrodes, as well as at points of contact between the electrodes. Such coatings have been described above, e.g., zirconium oxide (in a suitable binder) or DAGs formed from chromium oxide or carbon suspensions. The high resistivity coating can be applied by pumping a slurry through a brush or flattened nozzle which is concurrently drawn over the surface area to be covered. Optionally, the coating is applied to just overlap the edges of the conductive coating. After application, the slurry is allowed to air dry, and is then fired to solidify the high resistivity material to the glass substrate and ensure adherence thereto. In the method of the invention, the conductive coatings and high resistivity coatings can be applied sequentially to the glass substrate in any order, concurrently with each other, or in alternation with co-firing.

Figure 6:
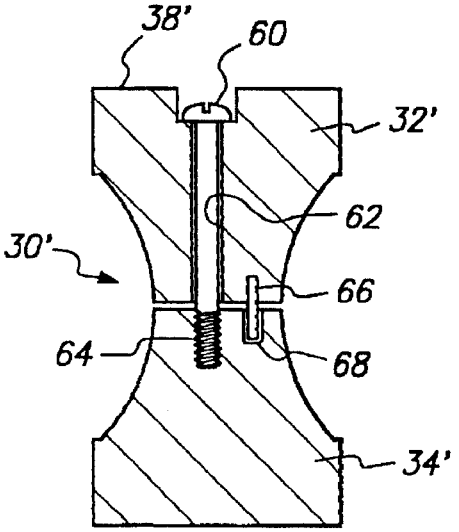
FIG. 6 is a sectional view of a split mandrel having optional alignment features that allow for accurate and secure mating of the component halves of the mandrel.

The split mandrels used herein to form the glass ring electrode can include optional alignment features that allow for accurate and secure mating of the component halves. Referring to FIG. 6, a split mandrel 30' is shown, having first and second component halves, respectively indicated at 32' and 34'. The component halves of the split mandrel are held in close register with each other using a detachable shoulder bolt 60. In particular, the first component half 32' contains a bore (or through-hole) 62 which extends from the first polar exterior surface 38' to align with a threaded seat 64 disposed in the second component half 34'. The bolt 60 is selected to have corresponding shoulder diameter and threads such that the bolt can be inserted through the bore 62 and threadably engage with the seat 64 to bring the first and second halves of the mandrel into close alignment with each other. These and other means, including index pin alignment means, can be used to maintain accurate alignment in the split mandrel. Referring still to FIG. 6, an exemplary index pin alignment means is depicted, wherein an index pin 66 is disposed in the first component half 32' of the mandrel. The index pin engages with a corresponding mounting hole 68 disposed in the second component half 34' of the mandrel. When the index pin 66 is engaged with the mounting hole 68, the first and second halves of the split mandrel can be maintained in close alignment with each other.

Figure 7:
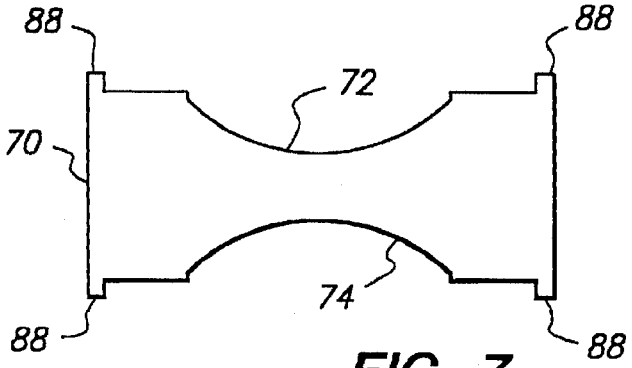
FIG. 7 is a plan view of a mandrel used to form glass end caps.

The above vacuum forming techniques can also be used to manufacture end-cap electrodes, in which the first step of the process also entails conforming glass end caps to a mandrel. Typically, the end-cap electrodes are formed from the same glass material as the corresponding ring electrode. Referring to FIG. 7, a single piece mandrel is generally indicated at 70. The mandrel 70 comprises first and second polar concave exterior surfaces, generally indicated at 72 and 74, respectively. The concave exterior surfaces each have a generally hyperbolic cross section. In the present method, a substantially planar glass substrate can be placed in contact with the one of the polar concave surfaces of the mandrel and attached to a suitable vacuum connector means as described above. Conformation of the glass substrate is then effected using vacuum and heat. After sufficient cooling, the mandrel can be removed from the substrate by cutting the glass substrate.

Figure 8:
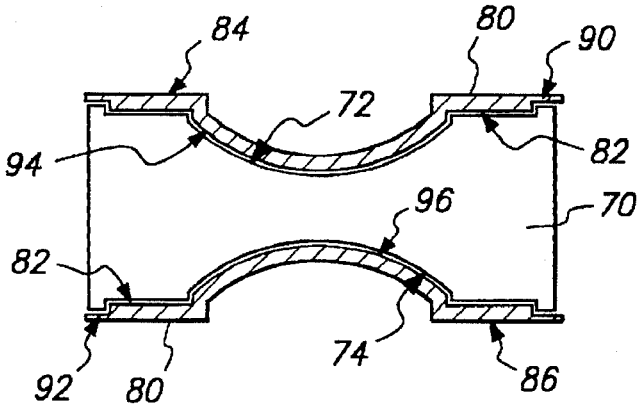
FIG. 8 is a sectional view of two glass substrates that have been conformed to the mandrel of FIG. 7 using vacuum and heat.

As depicted in FIG. 8, one alternative method entails inserting the mandrel 70 axially into a cylindrical glass substrate 80 having an interior surface 82. The cylindrical glass substrate is then sealed and attached to a suitable vacuum connector. When the substrate is evacuated and heated, the interior surface 82 of the glass substrate conforms to the first and second concave exterior surfaces, 72 and 74, of the mandrel 70. In this way, first and second end caps, generally indicated at 84 and 86, are formed which have convex hyperbolic interior surface configurations, indicated at 94 and 96 respectively, that are defined by the dimensions of the concave exterior surfaces of the mandrel 70. The end caps can be cut to remove the mandrel, and the cut ends of the end caps trimmed, machined and polished as described above.

Referring now to FIGS. 7 and 8, an alternative method entails the provision of centering details formed into the first and second end caps. In particular, the mandrel 70 can be machined to include registering means, generally indicated at 88 which are disposed on the exterior surface of the mandrel. As best seen in FIG. 8, conformation of the glass substrate 80 to the exterior surface of the mandrel 70 provides each end cap 84 and 86 with a shoulder, respectively indicated at 90 and 92, which extends about the periphery of the end caps. The shoulder provides a centering detail whereby the end caps can be accurately aligned with complementary edges of the ring electrode, allowing rapid and accurate assembly or disassembly of an ion trap formed with the subject end caps. If desired, the shoulders 90 and 92 can be cut away to provide, for example, three discrete centering details on each end cap, reducing the surface area contact between the ring electrode and the end caps.

The end-cap electrodes are then formed from the first and second end caps 84 and 86 by coating the convex interior surfaces thereof with a conductive material as described above. Thus, the end-cap electrodes each comprise a conductive, convex interior surface with generally hyperbolic cross sections. Further, high resistivity coatings can be applied as previously described.

The glass hyperbolic ion trap is then assembled by placing the convex interior surfaces of the end-cap electrodes within the ring electrode such that those surfaces are arranged adjacent to the interior surface of the ring electrode, and are in facing relation to each other, thereby defining a hyperbolic chamber. The three electrodes can be fixably aligned to maintain the ion trap formation using external detachable alignment means, such as a plurality of spring clips or the like.

Figure 9:
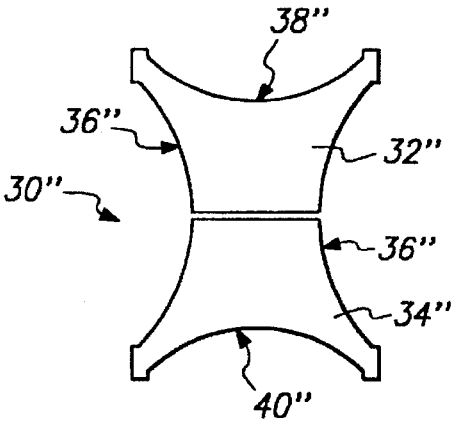
FIG. 9 is plan view of a specialized split mandrel that can be used to mold the hyperbolic interior surfaces of a glass tube and two glass end caps simultaneously.
Figure 10:
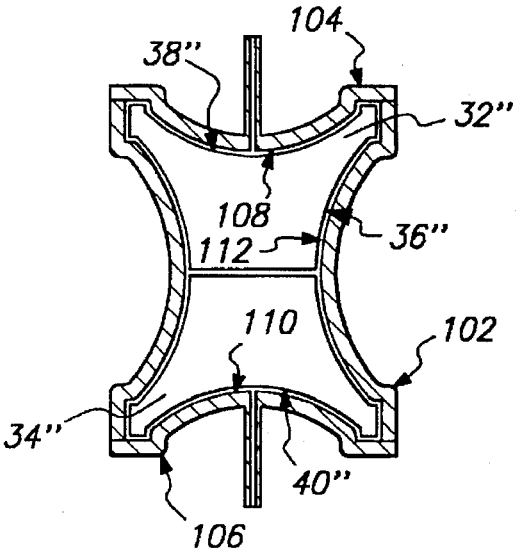
FIG. 10 is a sectional view of two glass end caps and a glass tube which have been conformed to the mandrel of FIG. 9 using vacuum and heat.

In a related embodiment, a method is provided for manufacturing all three electrodes, e.g., the end-cap electrodes and the ring electrode, of a glass hyperbolic ion trap from one vacuum conformed piece using a specialized split mandrel. Referring now to FIGS. 9 and 10, a split mandrel, generally indicated at 30" is shown, having first and second component halves 32" and 34". The component halves are fitted together to form a mandrel body having external dimensions that correspond to the desired internal dimensions of the ring electrode substrate which is to be formed. The mandrel 30" has a substantially centrally located concave annulus 36" that extends latitudinally about the exterior surface of the mandrel. The concave annulus has a generally hyperbolic cross section. In addition, the mandrel 30" has first and second polar concave exterior surfaces, 38" and 40", which have generally hyperbolic cross sections.

Referring particularly to FIG. 10, the mandrel 30" is inserted axially into an open glass cylinder, generally indicated at 102, which is subsequently sealed on either end with annealed first and second glass vacuum connector means 104 and 106, respectively. The vacuum connector means comprise the preform substrate from which the end caps will be formed. The glass cylinder 102 comprises the preform substrate from which the elongate glass tube will be formed. As described above, the interior of the sealed cylinder is evacuated using the vacuum connectors, allowing the cylinder to conform to the exterior surfaces of the mandrel 30" by application of heat.

The resulting molded product thus includes three interconnected components, including first and second end caps and an elongate glass tube. The convex interior surfaces, 108 of the first end cap, and 110 of the second end cap, have three-dimensional configurations that respectively match the corresponding polar concave exterior surfaces 38" and 40" of the mandrel 30". The interior surface 112 of the elongate glass tube comprises a centrally located convex annulus which matches the corresponding exterior surface 36" of the mandrel. After sufficient cooling, the method further entails cutting the conformed end caps from the elongate glass tube to remove the mandrel and provide substrates which can be converted into electrodes by coating the appropriate hyperbolic surfaces with conductive materials using the above-described techniques. The resultant end-cap electrodes can then be assembled with the resultant ring electrode to provide a hyperbolic ion trap assembly.

Figure 11:
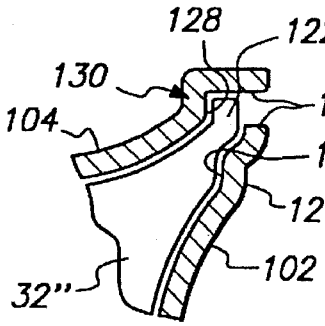
FIG. 11 is a sectional view depicting an optional self-aligning detail of a mandrel similar to the mandrel of FIG. 9, which detail allows for the accurate register of a conformed end cap and glass tube.

In an alternative method, the mandrel 30" is designed to have an oversized length that can be used to compensate for the thickness of the glass cuts used to separate the end caps from the elongate glass tube after the conforming process. Referring now to FIG. 11, the junction of the end cap and the elongate glass tube conformed from the vacuum connector means 104 and glass cylinder 102 is shown in enlarged detail. A cut 120 has been made, separating the end cap from the glass tube. An extended portion 122 of the mandrel component half 32" provides a self-aligning detail which will allow for the accurate register of the conformed end cap and glass tube. Particularly, the interior surface 124 of a shoulder 126 of the conformed glass tube will be sized to nest with the interior surface 128 of a complementary feature 130 of the conformed end cap. Thus, after the end cap and glass tube have been converted to electrodes, an ion trap is readily assembled with the self-registering features.

The specialized split mandrel 30" can include optional alignment features which allow for accurate and secure mating of the component halves, such as has been described above. Further, the mandrel may be formed from any suitable refractory material, as also previously described herein.

In yet another embodiment, a mass spectrometer is provided which includes a glass hyperbolic ion trap constructed in accordance with the invention. The spectrometer includes means for introducing ions, or a sample analyte to be ionized, into the glass ion trap, an ion multiplier and a processing unit capable of providing an output representative of the mass of molecules passing from the ion multiplier.

Ions that have been formed inside the glass hyperbolic ion trap, or introduced therein from associated ionizing means can be analyzed in the present mass spectrometer using several different scanning techniques. Mass-selective instability scanning is the most common technique. Changes in operating voltages are used to cause trapped ions of a particular m/z to adopt unstable trajectories. By stepping the amplitude of the rf voltage (V) applied to the ring electrode, ions of successively increasing m/z attain unstable trajectories and exit the glass ion trap. Exiting ions are detected using the associated electron multiplier or a Faraday cage collector to record the mass spectrum.

Resonant ejection scanning can also be used to analyze the stored ions in the glass ion trap. This technique is based on the recognition that, for a fixed set of operating conditions, ions of discrete m/z exhibit characteristic frequencies of axial and radial motion. These frequencies are dependent in part upon the amplitude of the rf voltage applied to the ring electrode. By stepping the rf voltage to the ring electrode, ions can be brought into resonance with a supplementary rf signal that is applied to the end-cap electrodes. As ions of different m/z values come into resonance with the supplemental signal, they absorb sufficient energy to exit the ion trap for detection at the associated detector. Resonant ejection techniques provide a significant extension in m/z range, whereby ions with m/z values exceeding 70,000 can be analyzed using an ion trap that has an upper m/z limit of only 650 when operated in the mass-selective instability mode.

Resonant ejection scanning techniques allow the present glass hyperbolic ion traps to be used in mass spectrometric analysis of virtually any compound which can be ionized and introduced into the trap. In addition, the ability to manipulate the trajectories of stored ions in the glass ion traps constructed herein, and perform tandem mass spectrometry/mass spectrometry (MS/MS) operations allows application of the spectrometers to a wide variety of analytical methods.

MS/MS is a process which involves the isolation of a "parent" ion, the dissociation of the parent ion to give characteristic ion products and the subsequent analysis of those products to obtain information about the parent ion using a second stage of mass analysis. In practice, ions formed from an analyte are stored in the glass hyperbolic ion trap, and the parent ion is mass selected. Selection of the parent ion can be achieved using mass-selective stability, wherein the combination of dc and rf fields are used to destabilize all trapped ions except those with the parent m/z value. Alternatively, the parent ions can be isolated using resonant ejection scanning techniques, where ions having higher and lower masses than the parent ion are ejected from the trap. The isolated parent ions are then dissociated to ion products as a result of energetic collisions in a helium bath gas, and the MS/MS spectrum of the parent ion obtained by sequentially ejecting the product ions using mass-selective instability scanning.

It is to be understood that while the invention has been described above in conjunction with preferred specific embodiments, the description and examples are intended to illustrate and not limit the scope of the invention, which is defined by the scope of the appended claims.

I claim:

1. A hyperbolic ion trap comprising:

a glass ring electrode having an interior surface with a convex portion having a generally hyperbolic cross section, a first open terminus and a second open terminus, wherein the convex portion has a conductive coating thereon;

a first glass end-cap electrode comprising a convex interior surface having a generally hyperbolic cross section with a conductive coating thereon, wherein said first end-cap electrode is fixably aligned within the first open terminus of the ring electrode such that the interior surface of the first end-cap electrode is adjacent to the interior surface of the ring electrode; and a second glass end-cap electrode comprising a convex interior surface having a generally hyperbolic cross section with a conductive coating thereon, wherein said second end-cap electrode is fixably aligned within the second open terminus of the ring electrode such that the interior surface of the second end-cap electrode is adjacent to the interior surface of the ring electrode and in facing relation with the interior surface of the first end-cap electrode, thereby defining a hyperbolic chamber.

2. The hyperbolic ion trap of claim 1, wherein the first and second end-cap electrodes further comprise centering means for accurately aligning said end-cap electrodes within the open termini of the ring electrode.

3. The hyperbolic ion trap of claim 1, wherein the ring electrode, the first end-cap electrode and the second end-cap electrode comprise a glass substrate having a silica content of at least about 80%.

4. The hyperbolic ion trap of claim 3, wherein the glass substrate comprises a quartz substrate.

5. The hyperbolic ion trap of claim 4, wherein the quartz substrate is comprised of silica, borate and alumina.

6. The hyperbolic ion trap of claim 4, wherein the quartz substrate is comprised of fused silica.

7. The hyperbolic ion trap of claim 4, wherein the quartz substrate is comprised of silica and $TiO_2$.

8. A method of manufacturing a glass hyperbolic ion trap, comprising:

(a) forming an elongate glass tube having an interior surface with a three-dimensional configuration comprising a substantially centrally located convex annulus with a generally hyperbolic cross section, said glass tube further having a first open terminus and a second open terminus;

(b) forming a ring electrode by coating the convex annulus with a conductive material;

(c) forming first and second glass end caps, each end cap having a convex interior surface with a generally hyperbolic cross section;

(d) forming first and second end-cap electrodes by coating the convex interior surfaces of the first and second glass end caps with a conductive material;

(e) covering the first open terminus of the ring electrode by aligning the first end-cap electrode with said first open terminus such that the interior surface of the first end-cap electrode is adjacent to the interior surface of the ring electrode; and (f) covering the second open terminus of the ring electrode by aligning the second end-cap electrode with said second open terminus such that the interior surface of the second end-cap electrode is adjacent to the interior surface of the ring electrode and in facing relation with the interior surface of the first end-cap electrode, thereby defining a hyperbolic chamber.

9. The method of claim 8, wherein in steps (e) and (f), the first and second end-cap electrodes are respectively held in alignment with the first and second open termini of the ring electrode by detachable alignment means.

10. The method of claim 9, wherein the detachable alignment means comprises a plurality of spring clips.

11. The method of claim 8, wherein the glass tube and the first and second glass end caps are formed from a glass substrate having a silica content of at least about 80%.

12. The method of claim 11, wherein the glass substrate comprises a quartz substrate.

13. The method of claim 12, wherein the quartz substrate is comprised of silica, borate and alumina.

14. The method of claim 12, wherein the quartz substrate is comprised of fused silica.

15. The method of claim 12, wherein the quartz substrate is comprised of silica and $TiO_2$.

16. The method of claim 8, wherein coating in steps (b) and (d) is effected using chemical vapor deposition.

17. The method of claim 8, wherein coating in steps (b) and (d) is effected using an evaporative or a sputtering technique.

18. The method of claim 8, wherein coating in steps (b) and (d) is effected by electroplating or electroless plating.

19. The method of claim 8, wherein coating in steps (b) and (d) is effected using a foil decal.

20. The method of claim 17, wherein the conductive material comprises a metal selected from the group consisting of silver, copper, aluminum, nickel, titanium, chromium, hafnium, gold and combinations thereof.

21. The method of claim 8, wherein step (a) comprises vacuum formation of the glass tube over a mandrel.

22. The method of claim 21, wherein formation of the glass tube in step (a) comprises:

(i) providing a mandrel having first and second portions;

(ii) attaching the first and second portions of the mandrel to each other to provide an elongate mandrel structure adapted to mold the interior surface of the glass tube to be formed;

(iii) providing an elongate cylindrical glass substrate having an interior surface;

(iv) placing the elongate mandrel structure within the elongate cylindrical glass substrate such that the mandrel is contained within said cylindrical glass substrate;

(v) conforming the interior surface of the elongate cylindrical glass substrate with the external surface of the elongate mandrel structure using vacuum and heat to provide an elongate glass tube having an interior surface with a three-dimensional configuration matching the dimensions of the exterior surface of the elongate mandrel structure; and (vi) removing the elongate mandrel structure from within the glass tube by detaching the first and second portions of the mandrel.

23. The method of claim 22, wherein the mandrel comprises a carbon or graphite substrate.

24. The method of claim 22, wherein the mandrel comprises a metal substrate having a greater thermal coefficient of expansion than that of the cylindrical glass substrate.

25. The method of claim 22, wherein the mandrel comprises a metal selected from the group consisting of stainless steel, nickel, tungsten, molybdenum and combinations thereof.

26. The method of claim 22, wherein the mandrel is comprised of tungsten or molybdenum, and the cylindrical glass substrate is comprised of quartz.

27. The method of claim 22, wherein the mandrel comprises an alloy of hafnium, carbon and molybdenum.

28. The method of claim 8, wherein the end caps formed in step (c) further comprise centering means disposed on the interior surface thereof.

29. The method of claim 8, wherein step (c) comprises vacuum formation of the end caps over a mandrel.

30. The method of claim 29, wherein formation of the first and second glass end caps in step (c) comprises:

(i) providing a mandrel having a concave exterior surface with dimensions that fit the dimensions of the convex hyperbolic interior surfaces of the first and second glass end caps to be formed;

(ii) providing a first, substantially planar glass substrate having an interior surface;

(iii) placing the interior surface of the first planar glass substrate in contact with the concave exterior surface of the mandrel;

(iv) conforming the interior surface of the first planar glass substrate with the concave external surface of the mandrel structure using vacuum and heat to provide a first glass end cap having a convex hyperbolic interior surface configuration defined by the dimensions of the exterior surface of the mandrel;

(v) providing a second, substantially planar glass substrate having an interior surface;

(vi) placing the interior surface of the second planar glass substrate in contact with the concave exterior surface of the mandrel; and (vii) repeating step (iv) to provide a second glass end cap having a convex hyperbolic interior surface configuration defined by the dimensions of the exterior surface of the mandrel.

31. The method of claim 30, wherein the mandrel comprises first and second polar concave exterior surfaces, said first polar concave exterior surface having dimensions that define the configuration of the convex hyperbolic interior surface of the first glass end cap to be formed and said second polar concave exterior surface having dimensions that define the configuration of the convex hyperbolic interior surface of the second glass end cap to be formed, whereby steps (iv) and (vii) can be carried out simultaneously.

32. The method of claim 22, wherein the first portion of the mandrel further comprises a first polar concave exterior surface and the second portion of the mandrel further comprises a second polar concave exterior surface, said first polar concave exterior surface having dimensions that precisely match the dimensions of the convex hyperbolic interior surface of the first glass end cap to be formed in step (c) and said second polar concave exterior surface having dimensions that precisely match the dimensions of the convex hyperbolic interior surface of the second glass end cap to be formed in step (c), whereby steps (a) and (c) can be conducted simultaneously to provide the elongate glass tube and the first and second glass end caps.

33. The method of claim 32, wherein the first and second polar exterior surfaces of the mandrel further comprise peripheral surface dimensions which respectively define first and second centering means disposed upon the interior surfaces of the first and second end caps to be formed in step (c).

34. A mass spectrometer comprising a glass hyperbolic ion trap manufactured by the method of claim 8.

35. A mass spectrometer comprising a glass hyperbolic ion trap.

36. The mass spectrometer of claim 35, wherein the glass hyperbolic ion trap comprises a quartz substrate.

* * * * *